US005138949A

United States Patent [19]

Swartout et al.

[11] Patent Number: 5,138,949

[45] Date of Patent: Aug. 18, 1992

[54] COMBUSTIBLE AMMUNITION CARTRIDGE CASE

[75] Inventors: Terry L. Swartout, Seminole; Stephen B. Ehlers, Clearwater; David R. Field, St. Marks, all of Fla.; Terence Connolly, Dover, N.J.

[73] Assignee: Olin Corporation, Cheshire, Conn.

[21] Appl. No.: 585,423

[22] Filed: Sep. 20, 1990

[51] Int. Cl.[5] ..... F42B 5/18

[52] U.S. Cl. ..... 102/431; 102/700

[58] Field of Search ..... 102/430, 431, 432, 433, 102/439, 465, 466, 467, 700

[56] References Cited

U.S. PATENT DOCUMENTS

| | | | |
|---|---|---|---|
| 1,263,763 | 4/1918 | Hasting . | |
| 3,216,356 | 11/1965 | Kaufmann, Jr. | 102/430 |
| 3,242,789 | 3/1966 | Woodring . | |
| 3,769,873 | 11/1973 | Abel | 102/431 |
| 3,955,506 | 5/1976 | Luther et al. . | |
| 3,978,792 | 9/1976 | Campoli et al. . | |
| 3,981,246 | 9/1976 | Luther et al. . | |
| 4,068,589 | 1/1978 | Overshol | 102/431 |
| 4,159,678 | 7/1979 | Luther et al. . | |
| 4,187,783 | 2/1980 | Campoli et al. . | |
| 4,359,925 | 11/1982 | Abet et al. . | |
| 4,444,113 | 4/1984 | Campoli . | |
| 4,444,115 | 4/1984 | Romer et al. . | |
| 4,487,131 | 12/1984 | Luther . | |
| 4,709,636 | 12/1987 | Mueller et al. | 102/431 |
| 4,714,024 | 12/1987 | Böcker et al. . | |
| 4,738,202 | 4/1988 | Hebert . | |
| 4,770,099 | 9/1988 | Brede et al. | 102/431 |
| 4,928,598 | 5/1990 | Sabranski et al. . | |
| 5,048,421 | 9/1991 | Swartout | 102/431 |

*Primary Examiner*—Harold J. Tudor
*Attorney, Agent, or Firm*—John R. Wahl

[57] ABSTRACT

An ammunition cartridge is disclosed comprising a projectile threadably attached to a combustible case body via a threaded combustible case adapter. At least one of the adapter end have an uniform density of polyurethane resin to provide strength and sufficient support for the threads. The combustible case body may also have an uniform resin density to support threads corresponding to those on the rear end of the adapter. The preferable uniform polyurethane density is about 0.75 grams per cubic centimeter.

7 Claims, 3 Drawing Sheets

COMBUSTIBLE AMMUNITION CARTRIDGE CASE

GOVERNMENT INTEREST

The invention described herein was developed under contract DAAA21-89-C-0094 and therefore may be manufactured, used and licensed by or for the Government for governmental purposes without the payment to us of any royalty thereon.

BACKGROUND OF THE INVENTION

This invention relates generally to combustible cartridges and more particularly to an improved case construction permitting the use of threaded case components.

Combustible cases for large caliber ammunition have been used for a number of years. The advantage of using such cases is especially apparent in tank ammunition where disposal of spent cartridge cases is constrained by the cramped confines within the fighting vehicle. The combustible cases used in such ammunition are designed to be consumed during propellant ignition, leaving behind only the short metal cartridge head containing the spent primer. Storage and handling spent cartridge heads measuring about three inches in length and five inches in diameter is much more convenient than wrestling with two foot hot long metal cases.

Combustible cartridge cases have a tubular body made of a molded or wrapped cardboard type mixture of wood fiber, Kraft cellulose, nitrocellulose, and a stabilizer. The cases are formed by the conventional beater additive or post impregnation process. The outer surface of the case body is impregnated with a plastic resin such as polyurethane to protect the case from humidity and abrasion damage and add strength to the case. The case has a density gradient of resin across the wall thickness of the case. The resin content is minimum at the inside surface and maximum at the outside. This gradient is conventionally believed to be necessary in order to ensure complete case combustion since the resin is a combustion inhibitor.

The tubular body is conventionally glued to a combustible adapter which attaches to the obturator of a projectile having its rear end extending through the adapter into the combustible cartridge case body. The adapter is a generally tubular cone which necks the case down to the bore diameter of the gun. The rear end of the adapter is glued to the case body and the front end of the adapter is bolted, glued or snap fit onto the obturator of the projectile.

The adapter is made of the same mixture as the case but usually without the nitrocellulose. The conventional adapter also has the same plastic resin gradient across its wall thickness.

The projectile is usually a shape charge warhead or a subcaliber kinetic energy long rod penetrator for defeating armor. It has its rear end extending into the forward end cf the combustible case through the adapter. The opposite end of the combustible case has a generally cup shaped metal head mechanically attached to it which provides a gun breech seal and a support for the primer which extends into the propellant within the combustible case.

These rounds have historically been very susceptable to joint failures during normal handling, changes in extreme humidity/temperature conditions and most importantly, accidental dropping. Accordingly, many efforts have been made to find the best joint arrangement and to improve the strength of these joints.

Such attempts are exemplified in the following patents. U.S. Pat. No. 3,978,792 to Campoli et al discloses a cartridge case adapter which fits over a fin hub for a fin stabilized projectile. The adapter is designed for use in a polypropylene cartridge case. The adapter is made of a polycarbonate resin material and engages the fins and rigidly supports them against the interior of the case. Thus, in this design, the adapter fits down inside the case and radially supports the finned projectile from the rear. This prevents the balloting of the long rod penetrator projectile within the case minimizing the forces placed on the joint between the projectile and the combustible case.

In U.S. Pat. Nos. 4,187,783 and 4,444,113, the sabots are snap fit to the obturator of the sabot.

In U.S. Pat. No. 4,444,115, the projectile is connected to the combustible casing via two axially spaced supports. The body portion of the projectile is supported at the neck of the case. A second, rear radial support is provided by radial support elements within the case abutting the case wall at the rear of the projectile.

In U.S. Pat. No. 4,487,131, a cartridge cover or adapter is disclosed which has a plurality of axial slots in its inverted conical forward end. These slots receive corresponding catches on the rear of the sabot on the subcaliber projectile as the projectile is inserted into the case. Thus, the forward end of the adapter is snap fit into engagement with the sabot. In addition, a silicon rubber seal is disposed between the case adapter and the sabot to provide a form adapted joint between the cartridge and the projectile. The rear portion of the cartridge cover or adapter has a conventional skive joint for gluing to the forward open end of the combustible case. This arrangement has the inherent disadvantage that the connection between the sabot of the projectile and the adapter is not particularly rigid.

U.S. Pat. Nos. 3,981,246 and 4,714,024 disclose conventional bolting methods between the combustible case adapter in the rear portion of the sabot. These bolted connections are strong but are relatively complex and require substantial assembly time. In addition, connection failures between the adapter and the sabot may not be readily apparent from a visual inspection.

Attempts to utilize threaded connections for combustible case components over twenty years ago met with dismal failure. Because of the resin density and thus a structural strength gradient across the wall thickness of the case, and the limited thickness of the case wall, machined threads simply disintegrated. Accordingly, threaded connections were believed to be unsuitable for use in combustible case components.

The preferred conventional joint between the adapter and the case body is a skive joint in which the case and the adapter are glued together. The skive joint presents an optimum glue surface area. The joints between the projectile and the adapter are either a snap fit, a compression fit between sabot components, a glued joint or a bolted connection between the adapter and the skirt of the obturator or the sabot.

One such conventional prior art connection scheme between the projectile and the combustible case is illustrated in FIG. 2. Cartridge 1 comprises a projectile 2 mounted to a combustible case 3 via adapter 4. Adapter 4 has a skive joint glued to case 3 at its rear end and has a bolted connection 5 at its forward end 6 to the sabot 7 of the projectile 2. The forward end 6 of the adapter 4 is shaped as a reverse cone having an angle corresponding to the tapered rear of sabot 7. A plurality of bolts 8 extend through both the forward end 6 of the adapter 4 and the rear tapered portion of the sabot 7 to connect the two pieces together.

This type of connection between the projectile and the adapter is strong but particularly susceptible to hidden joint failures in the region of the bolted connections. In addition, this type of connection is difficult and time consuming to assemble because of the recessed position of the bolts.

Both of these joints, the case to adapter and the adapter to projectile have frequently failed drop tests or have failed during field use over the years. This has thus been a long term problem with this particular type of cartridge. Accordingly, a need has existed for a better and more reliable method to fasten the combustible case components together.

It is therefore an object of the invention to provide an improved combustible case material into which threads can be machined.

It is another object of the present invention to provide an improved connection between combustible case components.

It is another object of the present invention to provide an improved connection between the projectile and the combustible case.

SUMMARY OF THE INVENTION

The present invention basically comprises a combustible case having a threaded joint between the adapter and at least one of either the case body or the obturator of the projectile. The threaded portion of the adapter has a uniform cross sectional density of plastic resin throughout its wall thickness to provide sufficient structural strength and machinability for the threads. This uniform density is critical to provide sufficient thread strength.

Although any thread type may be used in accordance with the invention, the threads are preferably of the helical modified stub type having a preferred pitch of about 0.10 (10 threads per inch). In addition, the threads preferably have a 60 degree thread angle and a flat thread root for ease of machining and to allow for expansion and contraction of the connected components due to temperature and humidity changes.

The adapter preferably has its forward end threaded with internal threads for joining with corresponding external threads on the projectile obturator. The adapter may also have internal or external threads on its rear end for engaging corresponding external or internal threads on the forward end of the combustible case body.

These and other objects, features and advantages of the invention will become more readily apparent from the following description when taken in conjunction with the accompanying drawing and appended claims.

DETAILED DESCRIPTION OF THE PREFERRED EMBODIMENTS

Figure 1:
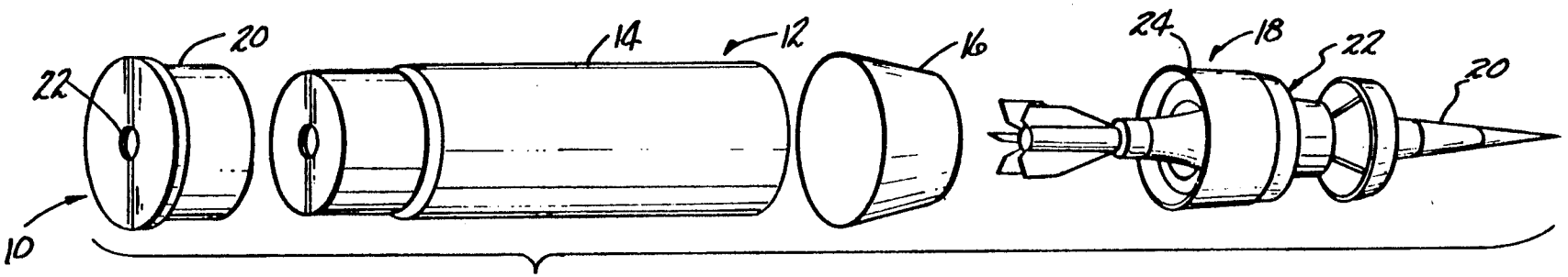
FIG. 1 is an exploded perspective view of the major components of an ammunition cartridge in accordance with the present invention.
Figure 2:
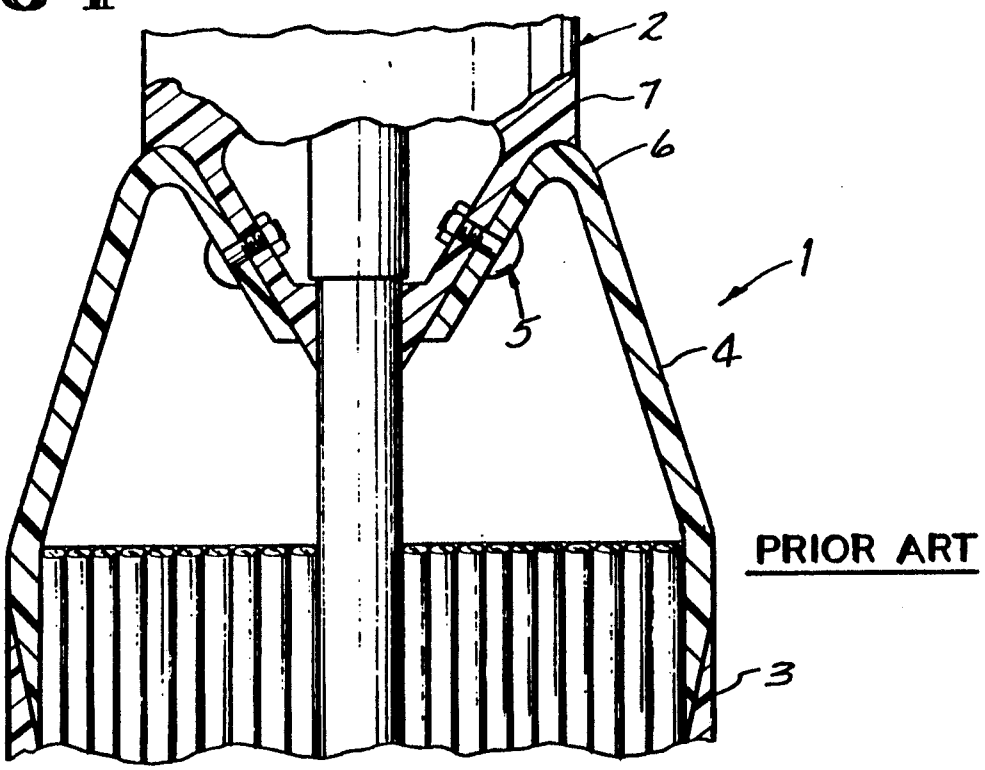
FIG. 2 is a sectional view of a cartridge having a typical prior art adapter.

FIG. 1 is an exploded view of a kinetic energy cartridge 10 in accordance with the invention having a combustible case 12. The cartridge case 12 basically includes a generally tubular body 14 and an adapter 16 secured to one end of the tubular body 14 for connecting a projectile 18 to the case 12. The other end of the case body has fastened thereto a metal head assembly 20 for receiving and supporting a primer 22 for igniting a propellant charge 24 (see FIG. 3) contained within the case 12.

The adapter 16 is a basically a combustible conical tube which connects the smaller diameter projectile 18 to the generally larger case body 14. The adapter 16 thus necks down from the diameter of the case to the diameter of the projectile.

The case body 14 is molded or otherwise conventionally formed via a felting process preferably from a mixture of nitrocellulose, wood pulp cellulose, N-Methyl-N', N'Dyphenylurea or diphenylamine (a nitrocellulose stabilizer) and preferably a polyurethane resin. The adapter is preferably made of the same mixture as the case but without the nitrocellulose and N-Methyl-N', N'Dyphenylurea. In some applications, the adapter also may contain these materials, however.

Both the adapter 16 and the combustible case 14 each have a differential density gradient of polyurethane across the wall thickness along its length. Both the adapter and the case body of the present invention have an uniform cross sectional density of polyurethane resin throughout the wall thickness of the component at the ends.

The felt density is decreased near the ends of the adapter or the case tube during formation so that a greater proportion of polyurethane resin is absorbed giving a resultant high uniform cross sectional density at the ends.

The uniform density at the ends should be between about 0.45 and 1.00 grams/cubic centimeter to ensure that the combustible case performs satisfactorily. The density should be at least 0.45 or there will be insufficient mechanical strength to retain the threads. It should be less than about 1.00 or the material will not properly combust upon propellant ignition. The resin density is preferably between about 0.55 and about 0.90 and has been found to be optimal at about 0.75 grams per cubic centimeter.

Projectile 18 typically includes a long rod shaped penetrator core 20 surrounded by a light weight sabot 22 which has an obturator 24 attached thereto or integral therewith. The rear portion of the projectile 18 is nested within case 12 and is attached thereto via a threaded connection between the adapter 16 and the obturator 24 in accordance with the invention.

Figure 3:
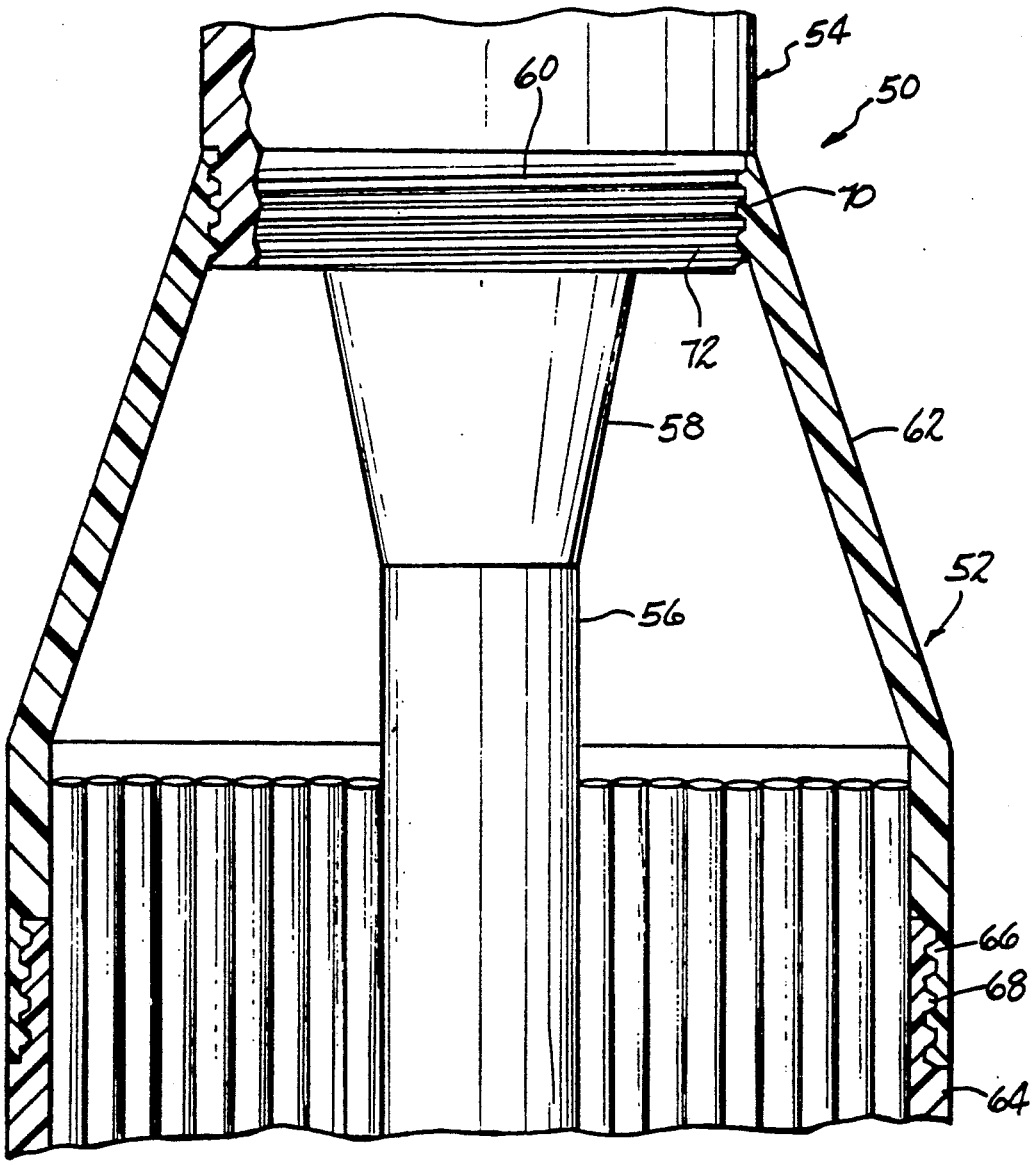
FIG. 3 is a partial longitudinal sectional view of one embodiment of a cartridge having an adapter in accordance with the present invention.

One preferred embodiment of the adapter portion of the cartridge in accordance with the present invention is illustrated in partial section in FIG. 3. Cartridge 50 comprises a combustible cartridge case 52 connected to a projectile assembly 54. In this case, the projectile assembly 54 is a long rod penetrator 56 supported by a sabot 58 having an obturator 60 which is threaded into a combustible adapter 62.

The combustible case 52 consists of the adapter 62 and a case tubular body 64. The forward end of the tubular body has external threads 66 machined into its external surface. The rear portion of the adapter 62 has internal threads 68 which correspond and engage with external threads 66 to provide a strong joint between the tubular body 64 and the adapter 62. Similarly, the forward end of the adapter 62 has internal threads 70 which engage corresponding threads 72 on the obturator 60.

The adapter 62 is preferably made of a molded or wrapped cardboard typed mixture of wood fiber, craft cellulose, and optimally nitrocellulose and is impregnated to an uniform density with a polyurethane plastic resin at the threaded ends. The polyurethane resin has an uniform density distribution throughout the wall thickness of the adapter 62 at the ends to permit machining the threads and to provide adequate strength for the threads 70 and 68. Similarly, the forward end of case body 64 has an uniform density of polyurethane resin to permit machining of and strength for the threads 66.

Figure 4:
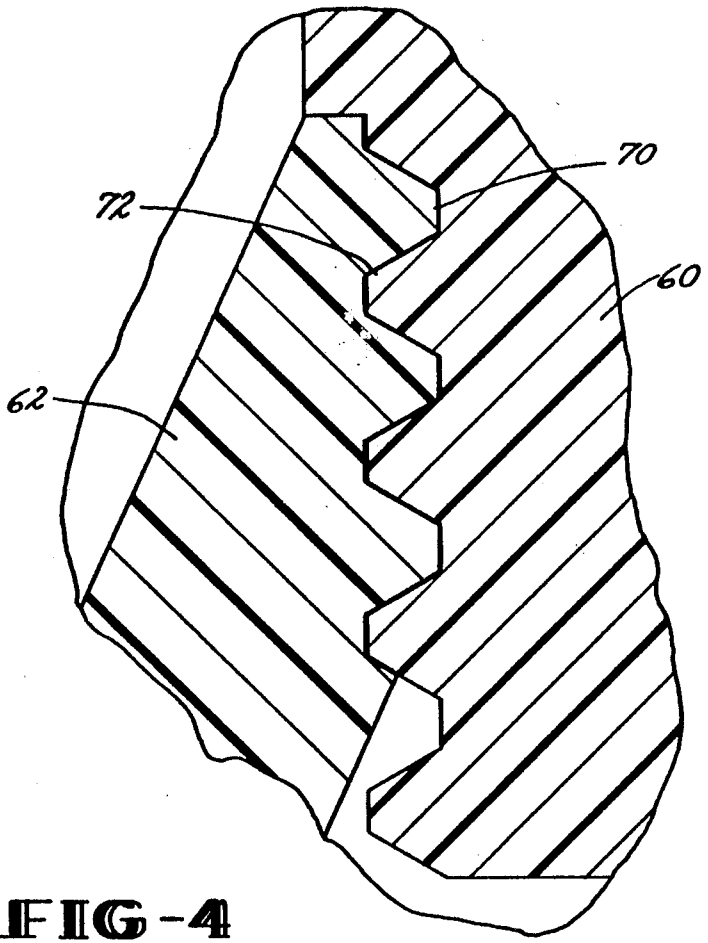
FIG. 4 is an enlarged partial sectional view of the threaded joint at the forward end of the adapter shown in FIG. 3.

The threads are preferably machined after the case and the adapter are molded. The threads are preferably a 60° modified stub thread as illustrated in FIG. 4. The threads preferably have a pitch of 0.10 and preferably have a flat root for ease of machining and to optimally allow for expansion and contraction of the joined components without failure due to temperature and humidity changes of the components. As shown in FIG. 3, the forward end of the adapter 62 is threaded onto the obturator 60. The obturator 60 is preferably made of nylon but may also be of any other conventional sabot or obturator construction supporting threads.

Figure 5:
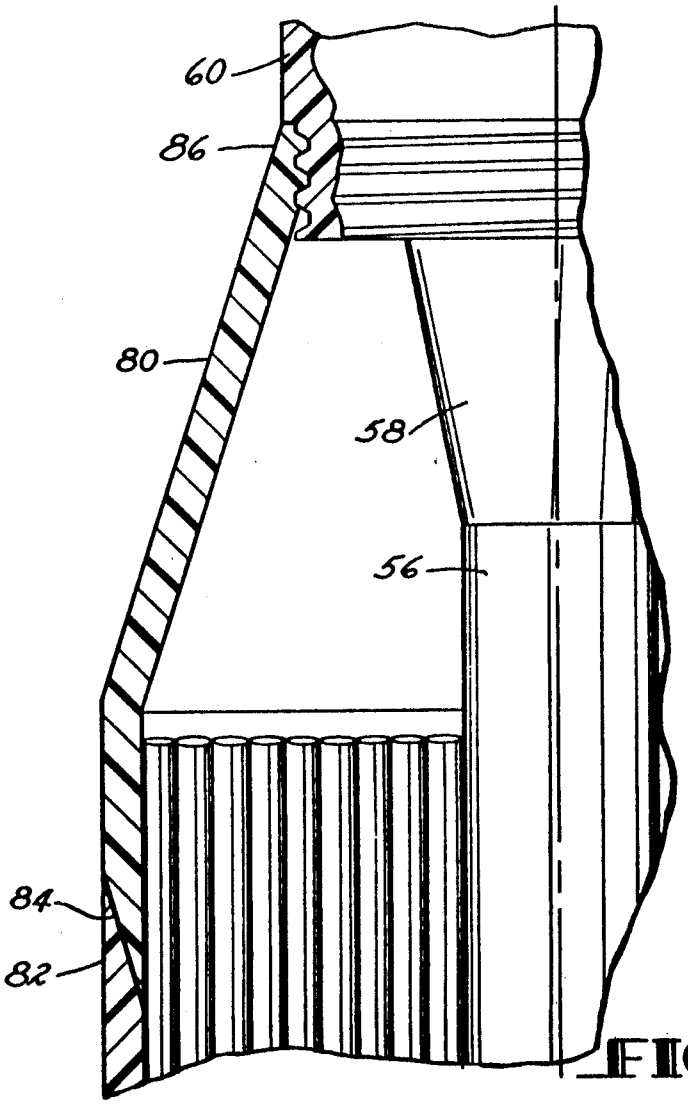
FIG. 5 is a partial sectional view of an alternative preferred embodiment of the cartridge in accordance with the invention.

An alternative preferred embodiment of a combustible cased cartridge in accordance with the present invention is illustrated in FIG. 5. In this embodiment, the adapter 80 is joined to the combustible case body 82 via a skive joint 84 in a conventional manner. In this case the polyurethane resin density at the joint 84 may be uniform or the components 80 and 82 may each have a conventional gradient across the wall thickness. The forward end 86 of the adapter 80 is threaded onto the obturator 60 as in the previous embodiment illustrated in FIGS. 3 and 4. Accordingly the forward end 86 must have an uniform resin density across its wall thickness as previously described.

While the invention has been described above with reference to specific embodiments thereof, it is apparent that many changes, modifications and variations can be made without departing from the inventive concept disclosed herein. For example, the obturator 60 may have internal threads and the forward end of the adapter 62 or 82 may have external threads so that the forward end of the adapter is threaded to the inside of the rear portion of the obturator 60. Similarly, the combustible case body 64 or 82 may have internal threads machined into the open end to mate correspondingly with external threads on the rear end of the adapter 62 or 80. Finally, the use of other plastic resins to provide an uniform strength within the wall of the combustible case body and the combustible adapter at the ends are envisioned. For example, a latex resin may also be used. Accordingly, it is intended to embrace all such changes, modifications and variations that fall within the spirit and broad scope of the appended claims. All patent applications, patents and other publications cited herein are incorporated by reference in their entirety.

What is claimed is:

1. An ammunition cartridge comprising:

a combustible case body having a tubular shaped wall with a central portion and at least one threaded open end portion, said central portion having a radial density gradient of a plastic resin across said wall, said threaded end portion of said body having a uniform cross sectional density of said plastic resin; and a hollow combustible adapter tube attached to said case body, said adapter tube having a central portion with a radial cross sectional density gradient of said plastic resin and at least one threaded end portion having a uniform cross sectional density of said plastic resin wherein said open end portion of said case body is threaded to said one threaded end of said adapter tube.

2. The cartridge according to claim 1 wherein said plastic resin is polyurethane.

3. The cartridge according to claim 1 wherein another threaded end portion of said adapter tube is threadably engaged with a projectile.

4. The cartridge according to claim 3 wherein said adapter tube has a generally frustoconical shape.

5. The cartridge according to claim 3 wherein said another end portion has a uniform cross sectional density of said plastic resin.

6. In an ammunition cartridge having a combustible case containing a propellant charge and a projectile attached to said case, said case comprising:

a combustible tubular body having a central portion and at least one threaded end portion, said central portion having a first felt density and a radial density gradient of a plastic resin, said one end portion having a second felt density lower than said first felt density, and a uniform cross sectional density of said plastic resin; and a threaded combustible adapter having one end portion threadably attached to the one threaded end portion of said body, said end portion of said adapter having a uniform cross sectional density of said plastic resin.

7. The cartridge according to claim 6 wherein said adapter has another end portion having threads engaging corresponding threads on said projectile to fasten said projectile and said adapter together.

* * * * *